US006149560A

United States Patent [19]

Kim

[11] Patent Number: 6,149,560

[45] Date of Patent: Nov. 21, 2000

[54] EXERCISE DEVICE

[76] Inventor: Hyung Jun Kim, #102-903 Hyundae, Apt. 576, Junggae-dong, Nowon-ku, Seoul 139-220, Rep. of Korea

[21] Appl. No.: 09/254,143

[22] PCT Filed: Jul. 10, 1998

[86] PCT No.: PCT/KR98/00203

§ 371 Date: Mar. 2, 1999

§ 102(e) Date: Mar. 2, 1999

[87] PCT Pub. No.: WO99/02221

PCT Pub. Date: Jan. 21, 1999

[30] Foreign Application Priority Data

Jul. 12, 1997 [KR] Rep. of Korea ..... 97/32470

[51] Int. Cl.[7] ..... A63B 26/00

[52] U.S. Cl. ..... 482/145; 482/143; 482/144; 482/147

[58] Field of Search ..... 482/142–145, 482/147, 907, 908; 310/80; 128/25, 57–8; 220/211

[56] References Cited

U.S. PATENT DOCUMENTS

| | | | |
|---|---|---|---|
| D. 269,543 | 6/1983 | Walper et al. | D24/3 |
| 3,307,534 | 3/1967 | Gibbs | 128/25 |
| 3,602,501 | 8/1971 | Garner | 272/58 |
| 3,817,243 | 6/1974 | Perrine | 128/57 |
| 4,232,662 | 11/1980 | Barber | 128/71 |
| 5,551,937 | 9/1996 | Kwo | 482/144 |
| 5,575,745 | 11/1996 | Lin | 482/144 |

FOREIGN PATENT DOCUMENTS

| | | |
|---|---|---|
| 28 54 142 A1 | 6/1980 | Germany . |
| 34 21 872 A1 | 12/1985 | Germany . |

*Primary Examiner*—Jerome W. Donnelly
*Assistant Examiner*—Lori Baker Amerson
*Attorney, Agent, or Firm*—Webb Ziesenheim Logsdon Orkin & Hanson, P.C.

[57] ABSTRACT

An exercise device includes a mat rotating device provided on the upper end of a base frame constituting a skeleton of the exercise device and adapted to rotate a mat frame rotatably mounted on the base frame through a desired angle when it is energized by electric power externally applied thereto, and a foot holder moving device provided on an extension member extending longitudinally from the mat frame and adapted to move foot holders when it is energized by electric power externally applied thereto. By the foot holder moving device, the foot holders move between an ankle holding position where the foot holders are positioned near support bars mounted to the extension member, respectively, to hold the ankle portions of the user therebetween and a release position where the foot holders are spaced away from the support bars, respectively, to allow the ankle portions of the user to be released. The rotation of the mat frame and the movement of the foot holders are carried out by drive forces from geared motors while being reduced in speed by the mat rotating device and the foot holder moving device.

6 Claims, 10 Drawing Sheets

EXERCISE DEVICE

BACKGROUND OF THE INVENTION

1. Field of the Invention

The present invention relates to an exercise device, and more particularly to an exercise device which includes a mat constructed to achieve its rotation through a certain angle and to stably and tightly hold the ankle portions of a user in a wider contact area, thereby allowing the user to perform a simple exercise, such as a repeated retraction of the upper body of the user, as in sit-ups, under the condition in which the mat is maintained at a horizontal position or a position inclined by an optional angle from the horizontal position.

2. Background Art

Generally, a person, such as a student or office worker, who studies or works in one position for a long period suffers back pain which is the central part of his body, or may be subjected to a variety of diseases through lack of exercise. In order to prevent diseases caused by lack of exercise, exercise devices, which are capable of allowing the user to perform a repeated retraction of his upper body thereby achieving an abdominal exercise or waist exercise, have been proposed to be placed at homes or in health rooms.

However, such conventional exercise devices are expensive due to their need for a complex drive unit for rotating a mat through a desired angle, thereby resulting in an increase in the manufacturing costs. Furthermore, such conventional exercise devices have difficulties in transportation and installation because of an increase in the volume and weight of the entire construction.

Although such conventional exercise devices have a foot holder adapted to hold the feet or ankle portions of a user, it is difficult for such a foot holder to meet different physiques of users because the foot holder is fixed to the mat. Moreover,such a foot holder, which is in contact with the body of the user during an exercise, has the shape of a straight extension. Due to such a shape, the foot holder is in contact with the body of the user in a local fashion. For this reason, the portion of the user's body locally contacting the foot holder is severely pressed. In severe cases, the user may suffer pain. Thus, the conventional foot holder has a problem in that it cannot hold the ankle portions of the user comfortably and stably.

SUMMARY OF THE INVENTION

Therefore, the present invention has been made in light of the above mentioned problems involved in the prior art. The object of the invention is to provide an exercise device which includes a simple drive unit adapted to rotate a mat frame through a certain angle, thereby being capable of achieving a reduction in the manufacturing costs, the exercise device also having a configuration capable of greatly reducing the entire volume and weight, thereby achieving easy installation and transportation, and comfortably and stably holding the ankle portions of a user.

Another object of the invention is to provide an exercise device including the stable ankle holders capable of holding the ankle portions of the user more comfortably in a wider contact area, and a simple drive unit adapted to rotate a mat frame, thereby achieving an improvement in safety, convenience, and reliability.

In accordance with the present invention, these objects are accomplished by providing an exercise device comprising: a base frame having a stable self-supporting strut structure; a mat frame rotatably mounted on an upper end of the base frame and fixing a mat on which a user can lean or lay; a length-adjustable extension member fixed at one end thereof to one longitudinal end of the mat frame; ankle holding means installed on the other end, namely, a free end, of the extension member and adapted to hold the ankle portions of the user, the ankle holding means including a pair of footholds fixedly mounted to the free end of the extension member while extending laterally from the free end of the extension member in opposite directions, respectively, a pair of support bars fixedly mounted to an end portion of the extension member disposed near the free end of the extension member while extending laterally from the free end of the extension member in opposite directions, respectively, and a pair of foot holders hingably mounted to the free end of the extension member in such a manner that they move with respect to the support bars, respectively; mat rotating means provided with a first geared motor and adapted to rotate the mat frame through a desired angle by a drive force from the first geared motor in a speed-reduced manner; and foot holder moving means provided with a second geared motor and adapted to move the foot holders between an ankle holding position where the foot holders are positioned near the support bars, respectively, to hold the ankle portions of the user therebetween and a release position where the foot holders are spaced away from the support bars, respectively, to allow the ankle portions of the user to be released, the movement of the foot holders being carried out by a drive force from the second geared motor in a speed-reduced manner.

The mat rotating means may comprise a casing fixed on the upper end of the base frame; an internal gear fixedly fitted in the casing and attached with a spacer to which the first geared motor is fixedly mounted; a pinion received in the internal gear, the pinion having a dedendum circle smaller than that of the internal gear in such a manner that it engages partially with the internal gear; a circular rotating member disposed at one side of the casing and fixed to the pinion in a concentric manner, the circular rotating member being provided at a circumferential outer surface thereof with a connecting member connected to the mat frame, so that the rotating member rotates the mat frame by a rotating force from the pinion; an eccentric shaft extending through an axial hole centrally defined in the pinion, the eccentric shaft having a central axial hole and an eccentric shaft portion fixedly fitted in the axial hole of the pinion, thereby causing the pinion to engage partially with the internal gear; a fixing member fixedly mounted to the internal gear and adapted to rotatably support an end of the eccentric shaft protruded from the axial hole of the pinion opposite to the first geared motor; and the first geared motor provided with an output shaft fixedly fitted in the central axial hole of the eccentric shaft in such a manner that they rotate together, the first geared motor serving to rotate the output shaft in forward and reverse directions in accordance with electric power externally applied thereto.

Each of the support bars and the associated one of the foot holders may have arcuate shapes mating with each other in such a fashion that they hold the ankle portion of the user while surrounding the ankle portion in a wider contact area, respectively, and cushioning members are fitted around the support bars and the foot holders, respectively.

The foot holder moving means may comprise a ring-shaped housing fixed to the free end of the extension member between the footholds; an internal gear formed in the housing; a circumferentially-extending arcuate slot formed through a portion of the housing disposed at one side of the internal gear; a pinion received in the internal gear, the pinion having a dedendum circle smaller than that of the internal gear in such a manner that it engages partially with the internal gear; a grip bar attached at one end thereof with the foot holders and fixed at the other end thereof to one side of the pinion in such a manner that it extends through the arcuate slot, the grip bar moving along the arcuate slot between two positions respectively corresponding to the ankle holding and release positions of the foot holders when the pinion rotates; a pair of spacers fixedly fitted in the housing in opposite sides of the internal gear, respectively, and adapted to prevent the pinion from being separated from the internal gear; an eccentric shaft extending axially through the pinion and the spacers, the eccentric shaft having a central axial hole and an eccentric shaft portion fixedly fitted in the axial hole of the pinion, thereby causing the pinion to engage partially with the internal gear; the second geared motor fixedly mounted to the housing by a mounting plate fixed to the end of the housing, where the arcuate slot is formed, the second geared motor being provided with an output shaft fixedly fitted in the central axial hole of the eccentric shaft in such a manner that they rotate together and serving to rotate the output shaft in forward and reverse directions in accordance with electric power externally applied thereto.

The foot holder moving means may further comprise an adjusting shaft fixedly mounted at one end thereof to the output shaft of the second geared motor and provided at the other end thereof with an adjusting knob adapted to manually rotate the adjusting shaft, the adjusting shaft serving to rotate the output shaft in accordance with a manual rotation of the adjusting knob, thereby rotating the grip bar, when the supply of electric power to the second geared motor is cut off.

The foot holder moving means may further comprise an arcuate cushioning member fitted in the arcuate slot while allowing the grip bar to move between the two positions thereof, the arcuate cushioning member serving to absorb an impact generated when the grip bar strikes against the housing at opposite ends of the arcuate slot.

BRIEF DESCRIPTION OF THE DRAWINGS

Other objects and aspects of the invention will become apparent from the following description of embodiments of the invention with reference to the accompanying drawings in which.

DETAILED DESCRIPTION OF PREFERRED EMBODIMENTS OF THE INVENTION

Figure 2:
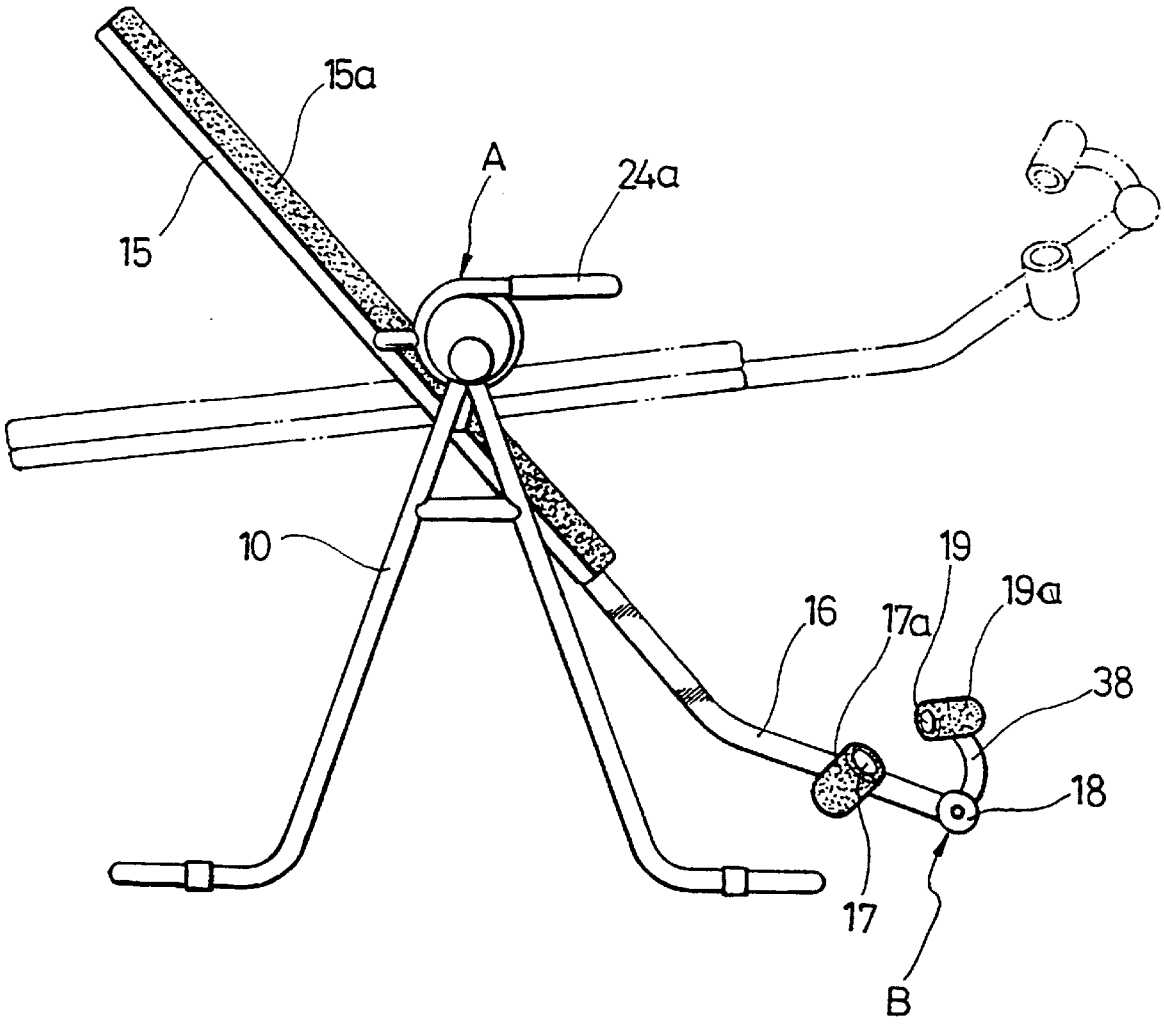
FIG. 2 is a side view of the exercise device shown in FIG. 1, illustrating the rotation of a mat through an optional angle.

Referring to FIG. 2, an exercise device according to one embodiment of the present invention is illustrated.

Figure 1:
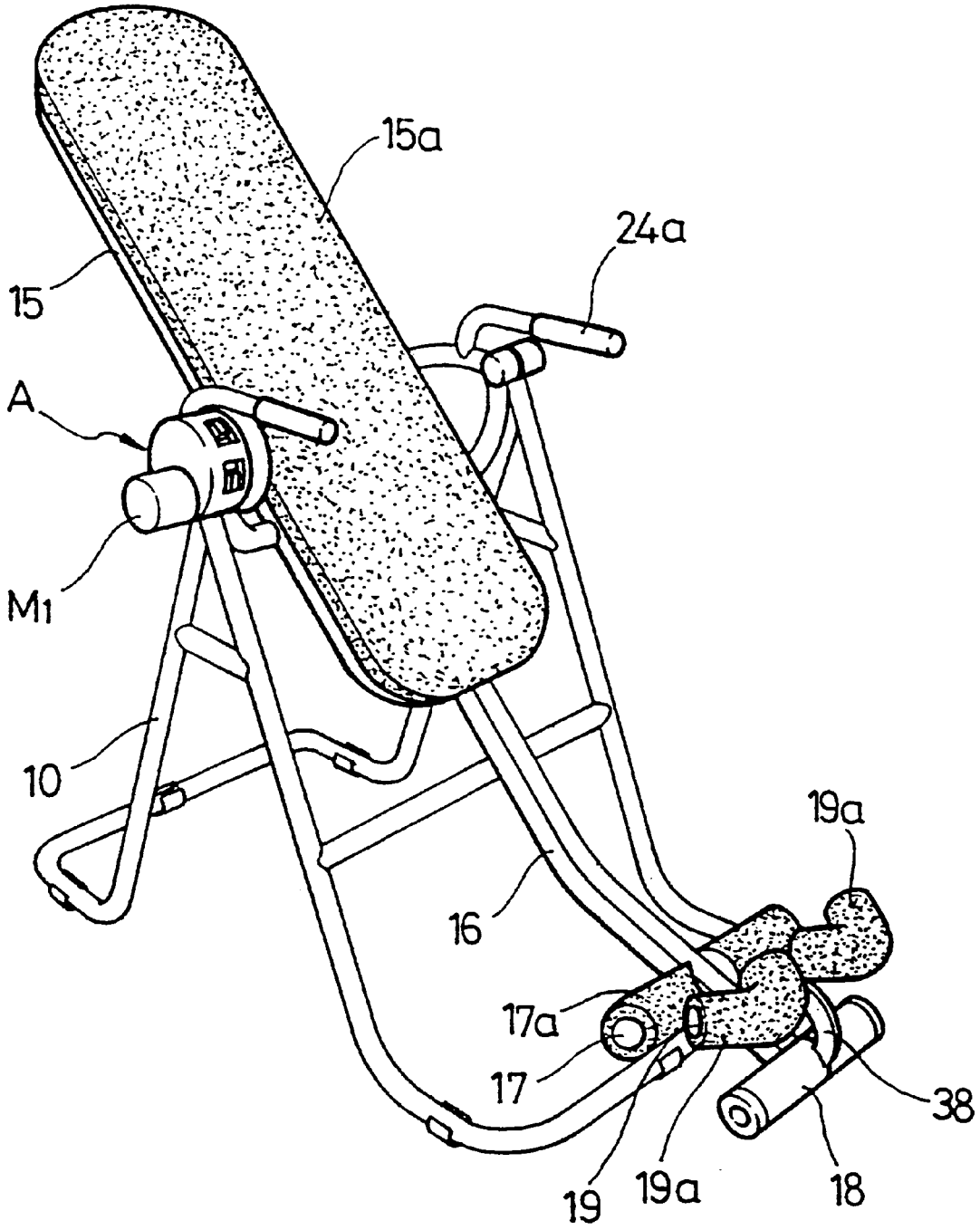
FIG. 1 is a perspective view illustrating an exercise device according to an embodiment of the present invention.

As shown in FIG. 1, the exercise device mainly includes a base frame 10 made of from pipes having a circular cross section to constitute a skeleton of the exercise device and a mat frame 15 hingably mounted on a central upper end of the base frame 10. The exercise device further includes a mat rotating means A provided on the upper end of the base frame 10 and adapted to rotate the mat frame 15 through a desired angle when it is energized by electric power externally applied thereto, an ankle holding means installed on an extension member 16 extending longitudinally from one end of the mat frame 15 and adapted to hold the ankle portions of a user, and a foot holder moving means B (see FIG. 2) provided on an extension member 16 and adapted to move foot holders included in the ankle holding means when it is energized by electric power externally applied thereto.

Figure 3A:
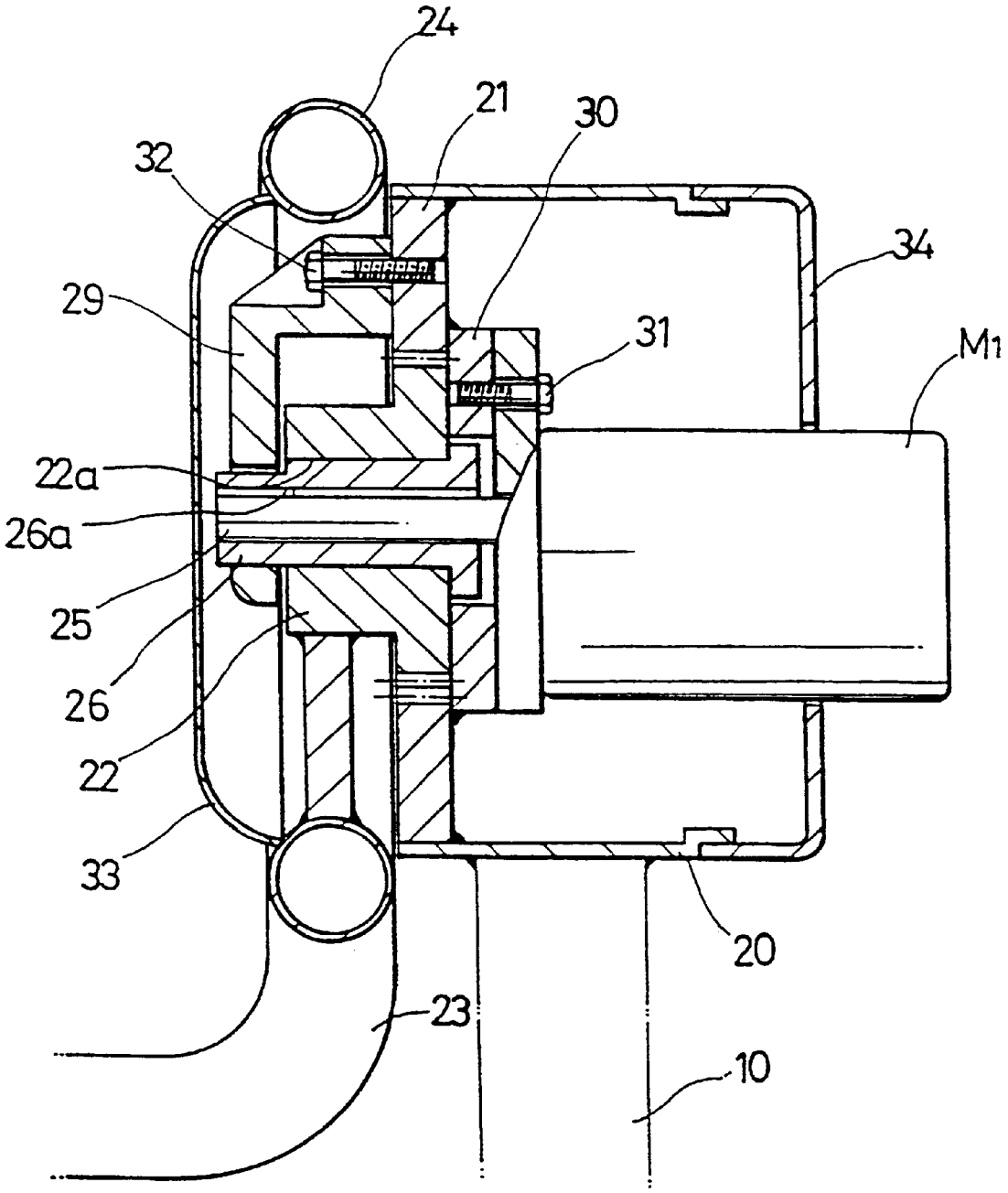
FIGS. 3*a* and 3*b* are a cross-sectional view and an exploded perspective view illustrating a mat rotating means included in the exercise device of FIG. 1, respectively.

When laterally viewed, the base frame 10 has an A-shaped structure including a pair of U-shaped struts connected at the upper ends thereof to each other while having a longitudinal space, defined therebetween, increasing gradually as they extend downwardly from their upper ends, respectively. The lower ends of the U-shaped struts are bent horizontally in opposite longitudinal directions, respectively, so that the base frame 10 can be stably maintained in an upright state. The base frame 10 has a width sufficient to allow the user to lay flat thereon. A cylindrical casing 20 is fixedly mounted to the upper end of the base frame 10 as shown in FIG 3*a*.

The mat frame 15 is attached with a mat 15*a* thereon and has a width allowing the user to lay flat thereon. As mentioned above, the extension member 16 extends longitudinally from one end of the mat frame 15. This extension member 16 consists of a length-adjustable elongated bar. A pair of support bars 17, a pair of footholds 18 and a pair of foot holders 19, which are included in the ankle holding means, are fixed to a free end of the extension member 16 in order to hold the ankle portions of a user.

The support bars 17 and foot holders 19 have arcuate shapes, respectively, in order to hold the ankle portions of the user more comfortably and stably in a wider contact area. Cushioning members 17*a* and 19*a*, which are made of a soft porous foam resin, are fitted around the support bars 17 and foot holders 19, respectively.

Figure 6:
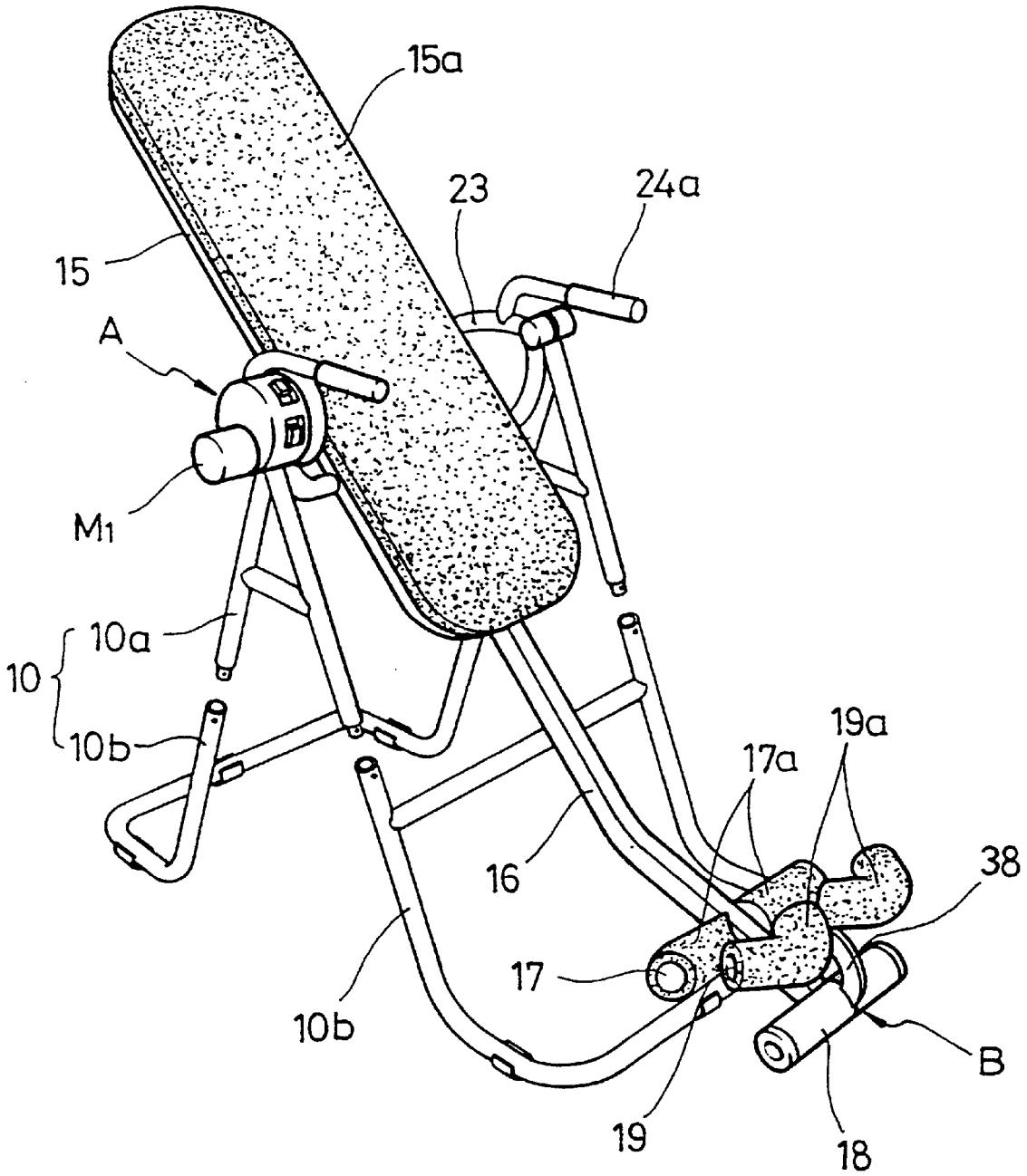
FIGS. 6 and 7 are a partially-exploded perspective view and a partially-broken side view illustrating another embodiment of the present invention associated with a base frame, respectively.
Figure 7:
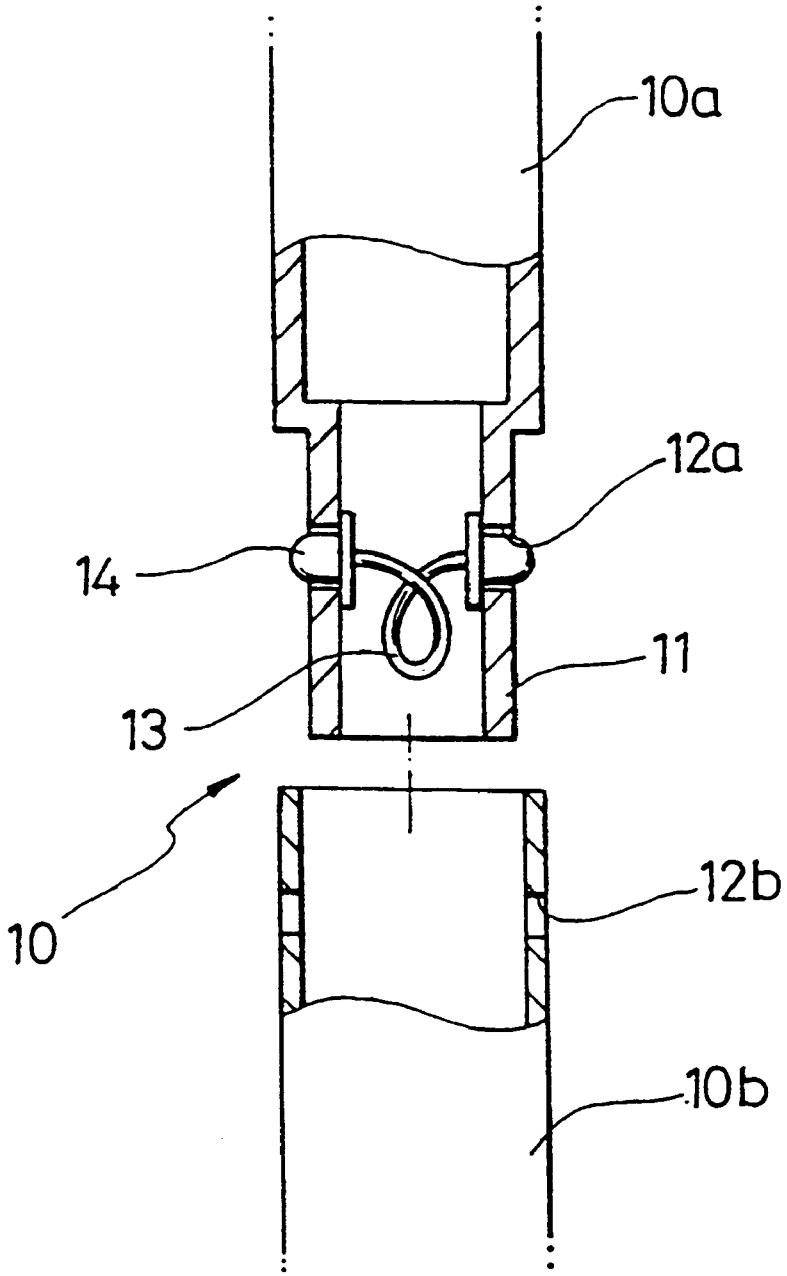

Although the base frame 10 is a unitary frame in the case illustrated in FIGS. 1 and 2, it may consist of two separate frames, namely, upper and lower frames 10*a* and 10*b*, coupled to each other, as shown in FIGS. 6 and 7.

In the case illustrated in FIGS. 6 and 7, the upper base frame 10*a* is provided at its lower end with a fitting portion 11. This fitting portion 11 of the upper base frame 10*a* is fitted in the upper end of the lower base frame 10*b*. Through holes 12*a* are formed in an aligned fashion through the fitting portion 11 of the upper base frame 10*a*. Through holes 12*b*, which correspond to the through holes 12*a*, respectively, are also formed in an aligned fashion through the portion of the lower base frame 10*b* in which the fitting portion 11 of the upper base frame 10*a* is fitted. Locking members 14 are fitted through the through holes 12*a* while being biased by a spring 13 in such a manner that they are always outwardly protruded. When the fitting portion 11 of the upper base frame 10*a* is fitted in the upper end of the lower base frame 10*b*, the locking members 14 are inserted into the through holes 12*b* of the lower base frame 10*b*, so that the upper and lower frames 10*a* and 10*b* are locked in a coupled state.

Figure 3B:
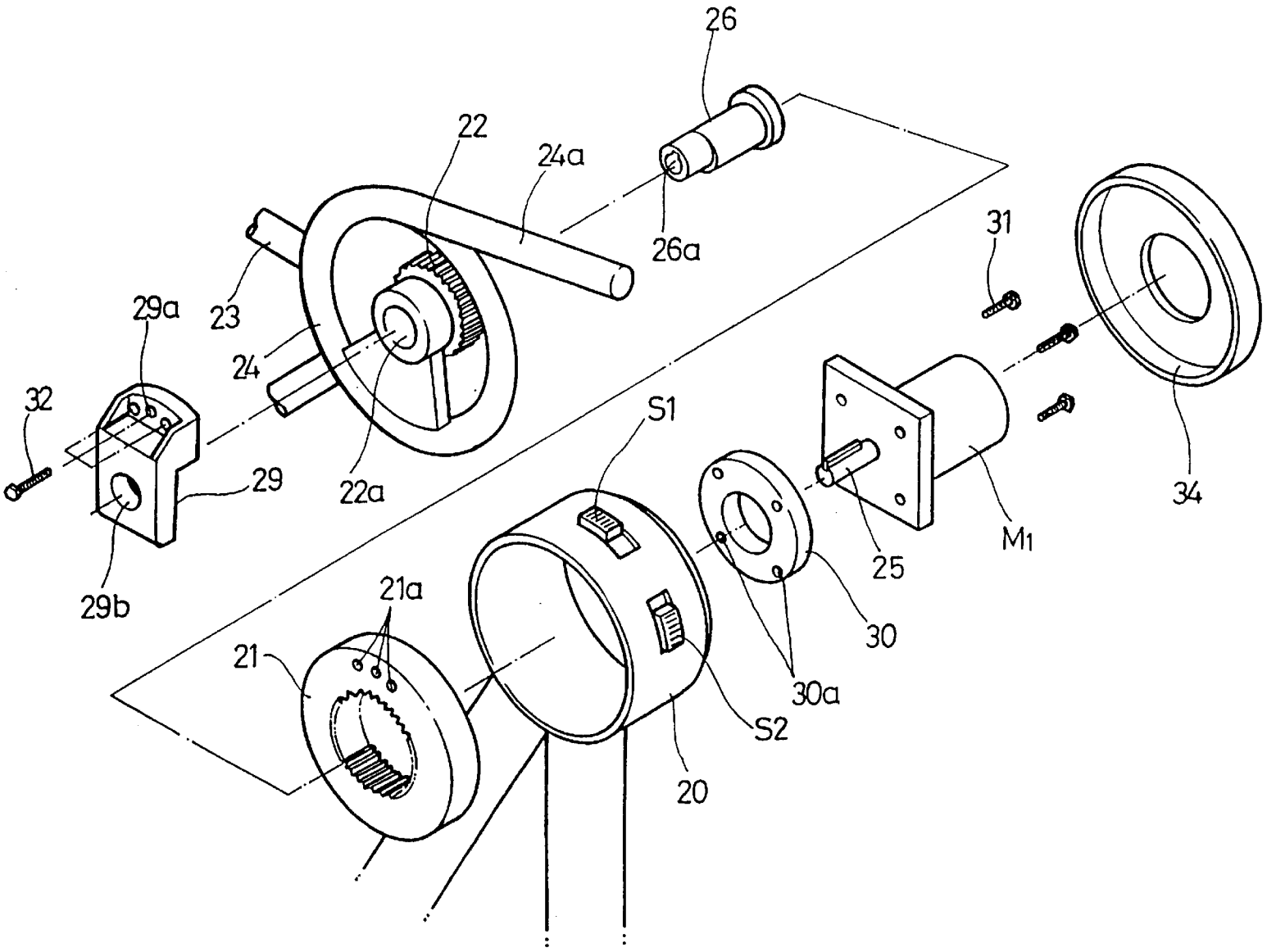

Referring to FIGS. 3*a* and 3*b*, the mat rotating means A includes a first internal gear 21, a first pinion 22, an eccentric shaft 26, a fixing member 29, and a first geared motor $M_1$.

The first internal gear 21 is fixed in the interior of the cylindrical casing 20 mounted on the upper end of the base frame 10. A first spacer 30 is attached to one side surface of the first internal gear 21. The first spacer 30 has a plurality of tapped holes 30*a* adapted to mount the first geared motor $M_1$.

The first pinion 22 has a dedendum circle smaller than the dedendum circle of the first internal gear 21 so that it engages partially with teeth formed on the inner circumferential surface of the first internal gear 21. A ring-shaped rotating member 24 is disposed on one side of the casing 20 opposite to the first spacer 30. The ring-shaped rotating member 24 is fixed to an axial extension extending axially from the first pinion 22 beyond the casing 20. A connecting member 23 is fixed on the outer circumferential surface of the rotating member 24. The connecting member 23 is connected to the mat frame 15.

A grip 24*a* extends from the connecting member 23 so that the user comfortably grips the grip 24*a* by hand at his leaning or laying position.

The eccentric shaft 26 is hollow to centrally define an axial shaft hole 26*a* therein. An output shaft 25 included in the first geared motor $M_1$ is fitted in the shaft hole 26*a* in a splined fashion. The eccentric shaft 26 has a stepped cylindrical structure including three shaft portions having different diameters. The intermediate shaft portion of the eccentric shaft 26 is eccentric with respect to the axis of the axial shaft hole 26*a*. When the eccentric shaft 26 is fitted in the first pinion 22, its intermediate shaft portion is disposed in an axial hole 22*a* centrally defined in the first pinion 22. Accordingly, the first pinion 22 engages partially with the first internal gear 21.

The first geared motor $M_1$ is fixedly mounted to the first spacer 30 attached to the first internal gear 21 by means of bolts 31 under the condition in which its output shaft 25 is fitted in the axial shaft hole 26*b* of the eccentric shaft 26.

The fixing member 29 has the form of an angle. The fixing member 29 is provided at its upper portion with coupling holes 29*a*. Coupling pieces 32, such as bolts, are inserted into the coupling holes 29*a* so that they are threadedly coupled to tapped holes 21*a* provided at the first internal gear 21, thereby causing the fixing member 29 to be fixed to the first internal gear 21. The fixing member 29 is also provided at its lower portion with an axial hole 29*b* adapted to rotatably receive the shaft portion of the eccentric shaft 26 protruded from the axial hole 22*a* of the first pinion 22.

A circular cover 33 is attached to the side of the rotating member 24 opposite to the casing 20, in order to shield the elements disposed in the interior of the casing 20 while preventing the user's hands from being stained with a lubricant coated on mechanical connections among those elements. Another circular cover 34 is attached to the end of the casing 20 opposite to the cover 33, in order to protect control units disposed in the interior of the casing 20. A first switch Si is installed on the casing 20 to control the supply of electric power to the first geared motor $M_1$. The first switch $S_1$ is also electrically connected to a control circuit (not shown) in order to switch the drive direction of the first geared motor $M_1$ between forward and reverse directions.

For reference, the procedure for assembling the elements of the mat rotating means A will be described hereinafter. First, the first internal gear 21, to which the first spacer 30 has been welded, is welded to the inner surface of the casing 20. Thereafter, the first pinion 22, which has been welded to the rotating member 24, is coupled to the first internal gear 21 in such a manner that its teeth engage partially with the teeth of the first internal gear 21. Subsequently, the eccentric shaft 26 is fitted around the output shaft 25 of the first geared motor $M_1$. In this state, the first geared motor $M_1$ is fixedly mounted to the first spacer 30, by means of the bolts 31, in such a manner that the eccentric shaft 26 extends through both the first spacer 30 and first pinion 22.

Thereafter, the fixing member 29 is fixed to the first internal gear 21. This fixing procedure is carried out by fitting the shaft portion of the eccentric shaft 26, protruded from the axial hole 22*a* of the first pinion 22, in the axial hole 29*b* of the fixing member 29 while aligning the coupling holes 29*a* of the fixing member 29 with the tapped holes 21*a* of the first internal gear 21, and inserting the coupling pieces 32 into the coupling holes 29*a* to threadedly couple the coupling pieces 32 to the tapped holes 21*a*. After the above assembly procedure, the covers 33 and 34 are attached to the rotating member 24 and tube 20, respectively.

Figure 8:
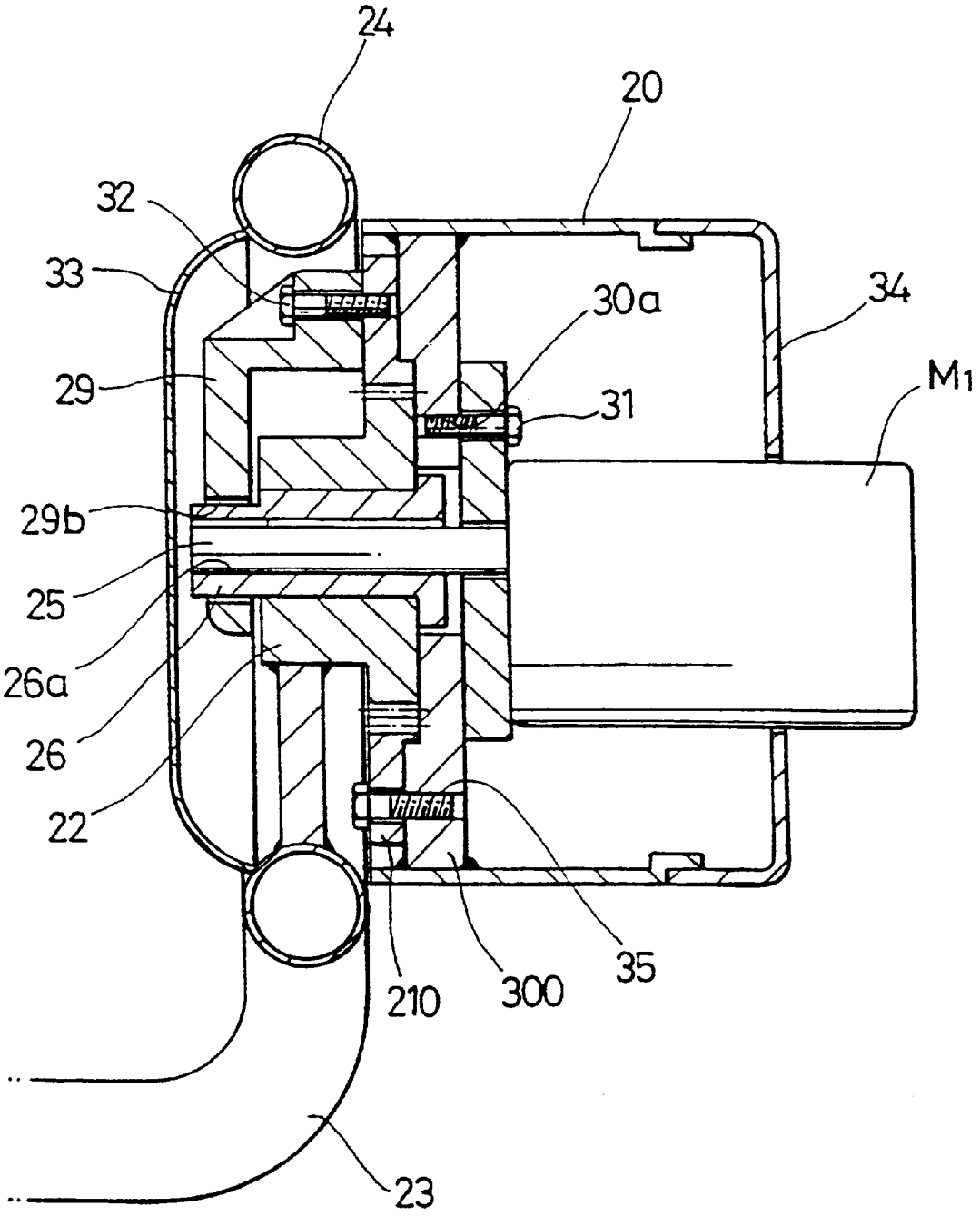
FIG. 8 is a cross-sectional view illustrating another embodiment of the present invention in which a first spacer and a first internal gear are modified from those of FIG. 3*a*.

Although the first spacer 30 has been described as being fixed to the cylindrical casing 20 by welding the first spacer 30 to the first internal gear 21 and then welding the first internal gear 21 to the cylindrical casing 20, it may be directly welded to the cylindrical casing 20, as shown in FIG. 8. In this case, the first internal gear, which is denoted by the reference numeral 210 in FIG. 8, may be coupled to the first spacer denoted by the reference numeral 300, by means of coupling pieces 35.

As mentioned above with respect to FIGS. 1 and 2, the extension member 16 extends longitudinally from one end of the mat frame 15. The support bars 17 and footholds 18 are fixedly mounted to the free end of the extension member 16 opposite to the mat frame 15 in such a manner that they extends laterally from opposite sides of the extension member 16, respectively. The foot holders 19 are fixedly mounted to one end of a grip bar 38 which is rotatably mounted to the free end of the extension member 16. The foot holders 19 are movable with respect to the support bars 17. The foot holder moving means B is carried in the interior of the footholds 18 in order to selectively move the foot holders 19 toward the support bars 17, so that the support bars 17 and foot holders 19 hold the ankle portions of the user therebetween.

Figure 4A:
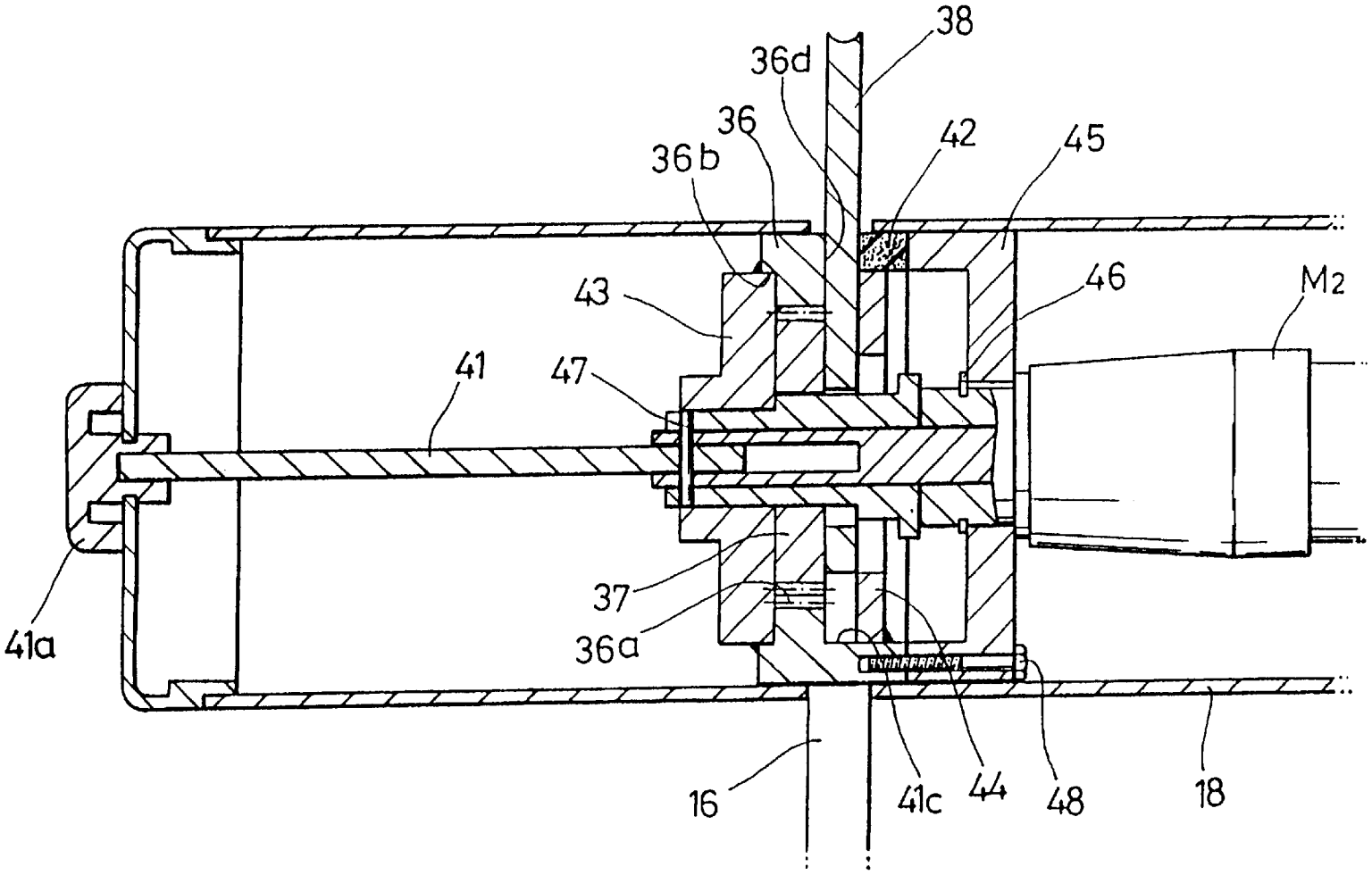
FIGS. 4*a* and 4*b* are a cross-sectional view and an exploded perspective view illustrating a foot holder moving means included in the exercise device of FIG. 1, respectively.
Figure 4B:
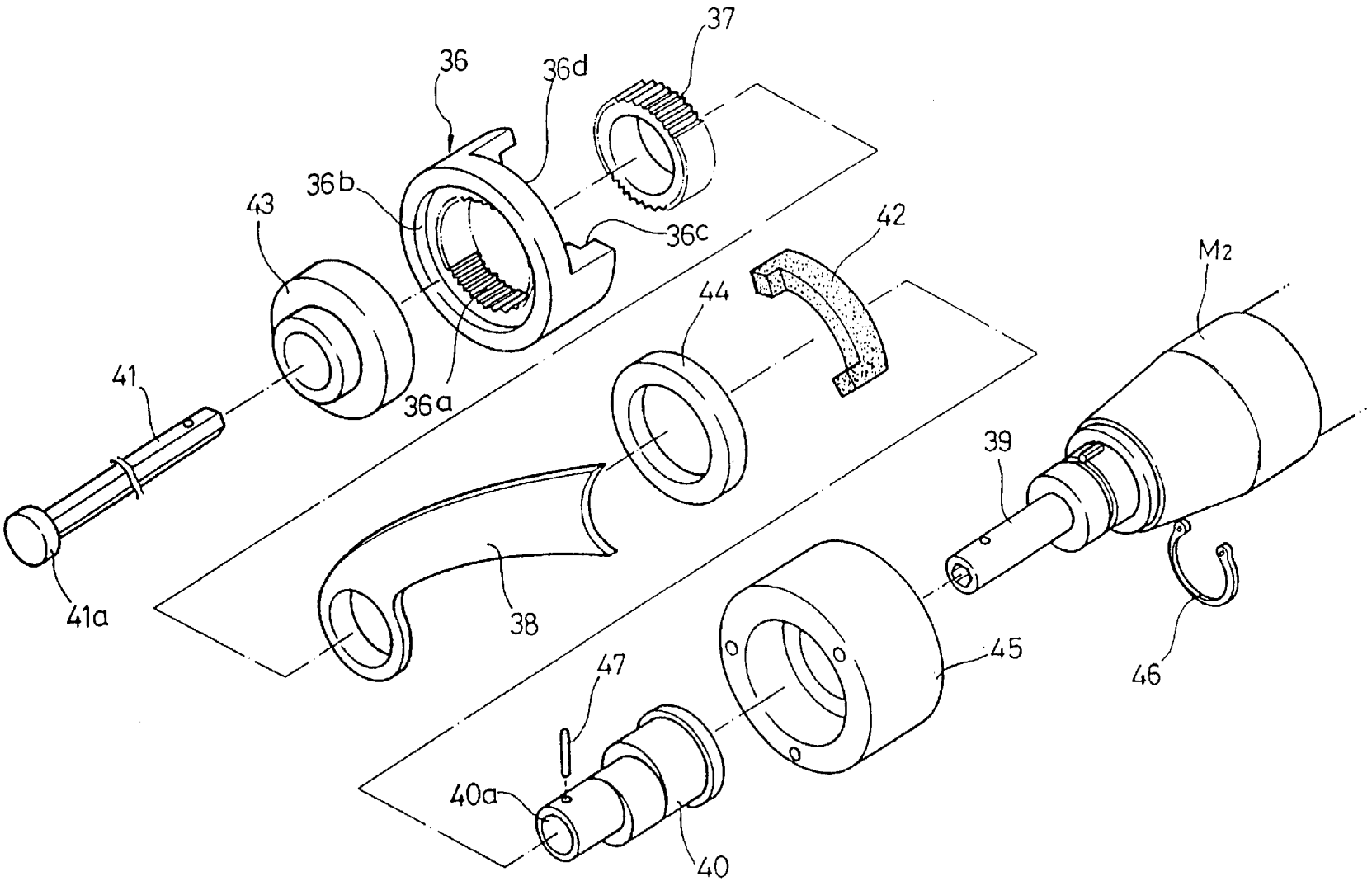
Figure 5:
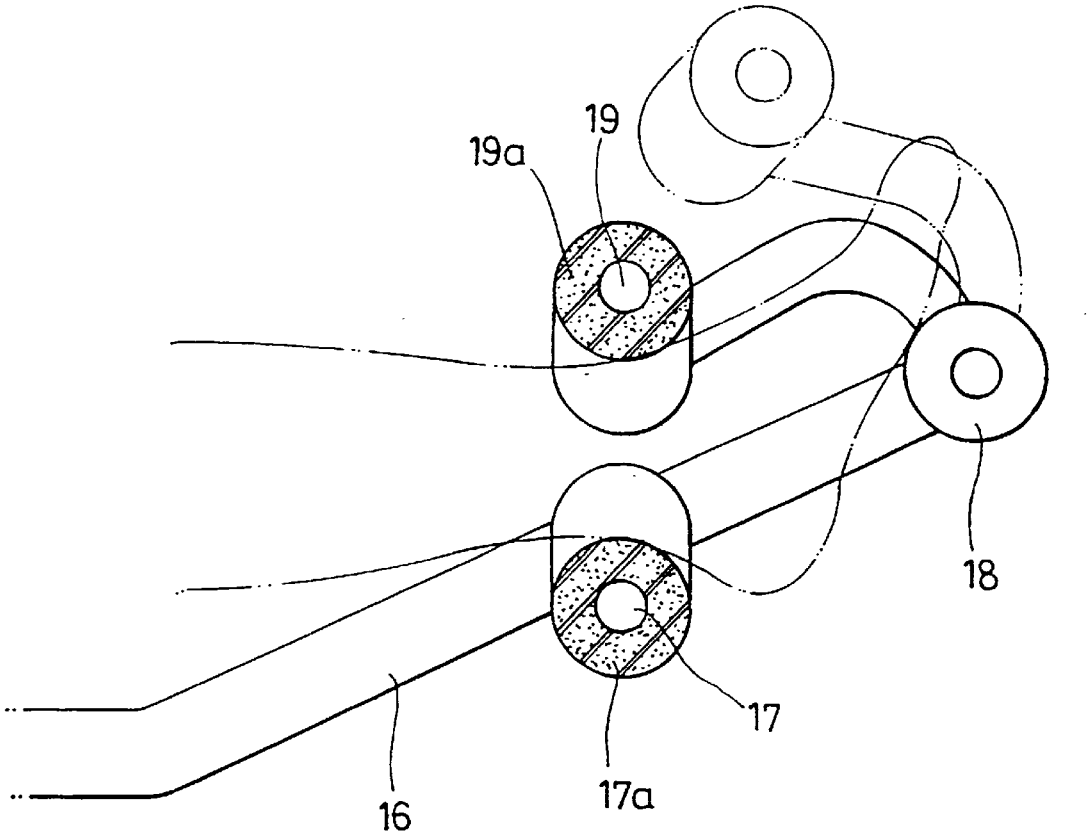
FIG. 5 is a schematic view illustrating a state in which the ankle portions of a user is tightly held by an ankle holding means included in the exercise device of FIG. 1.

Referring to FIGS 4*a* and 4*b*, the foot holder moving means B includes a housing 36, a second pinion 37, to which the other end of the grip bar 38 is fixed, an eccentric shaft 40, a second geared motor $M_2$, an adjusting shaft 41, and a cushioning member 42.

The housing 36 is fixed to the free end of the extension member 16 by means of welding. The housing 36 is provided at its inner circumferential surface with a second internal gear 36*a*. A pair of holes 36*b* and 36*c* are defined in the housing 36 in opposite sides of the second internal gear 36*a*, respectively. The holes 36*b* and 36*c* have a diameter larger than the diameter of the dedendum circle of the second integral gear 36*a*. The portion of the housing 36 defining the hole 36*c* is partially cut out in a radial direction, thereby forming an arcuate slot 36*d*.

The second pinion 37 has a dedendum circle diameter smaller than the dedendum circle diameter of the second internal gear 36*a* so that it engages partially with teeth formed on the inner circumferential surface of the second internal gear 36*a*. The grip bar 38, which is attached to one side of the second pinion 37, has an arcuate shape.

Second and third spacers 43 and 44 are fitted in the holes 36*b* and 36*c* and welded to the inner circumferential surface of the housing 36, respectively, under the condition in which the second pinion 37 engages with the second internal gear 36*a*. Together with the second pinion 37, the grip bar 38 can rotate within an angle defined by the arcuate slot 36*d* of the housing 36.

The cushioning member 42 is fitted in the arcuate slot 36*d* in order to absorb an impact generated when the grip bar 38 strikes against the ends of the arcuate slot 36*d*. The cushioning member 42 has an arcuate shape corresponding to that of the arcuate slot 36*d*. The arcuate slot 36*d* of the housing 36 and the cushioning member 42 may be provided with a coupling hole and a coupling protrusion mating with each other, respectively, for an interconnection therebetween.

The eccentric shaft 40 is hollow to centrally define an axial shaft hole 40*a* therein. A hollow output shaft 39 included in the second geared motor $M_2$ is fitted in the shaft hole 40*a*. The eccentric shaft 40 has a stepped cylindrical structure including a plurality of shaft portions having different diameters. The intermediate shaft portion of the eccentric shaft 40 is eccentric with respect to the axis of the axial shaft hole 40*a*. When the eccentric shaft 40 is fitted in the second pinion 37, its intermediate shaft portion is disposed in the second pinion 37, so that the second pinion 37 engages partially with the second internal gear 36*a*.

The second geared motor $M_2$ is fixedly mounted to one end of the housing 36 by means of a mounting plate 45. The second geared motor $M_2$ serves to rotate its output shaft 39 in forward and reverse directions when it is energized by electric power. The mounting plate 45 is fixedly mounted to one end of the housing 36 by means of coupling pieces 48. The second geared motor $M_2$ is fixedly mounted to the mounting plate 45 by means of a key denoted by no reference numeral and a snap ring 46.

The adjusting shaft 41 is fitted at one end thereof, namely, an inner end thereof, in an axial shaft hole defined in the output shaft 39 of the second geared motor $M_2$. The adjusting shaft 41 has a length extending from the outer end of the foothold 18 opposite to the second geared motor $M_2$ to the interior of the output shaft 39. The adjusting shaft 41 has a hexagonal cross section corresponding to that of the axial shaft hole of the output shaft 39. Pin holes are formed through the inner end of the adjusting shaft 41 and the portions of the output shaft 39 and eccentric shaft 40 corresponding to the adjusting shaft inner end, respectively. When the output shaft 39, eccentric shaft 40 and adjusting shaft 41 are assembled together in such a manner that their pin holes are aligned together, a pin 47 is inserted into the aligned pin holes, so that the shafts 39, 40 and 41 are fixed together. A circular adjusting knob 41*a* is mounted to the other end of the adjusting shaft 41 disposed outside the foothold 18 opposite to the second geared motor $M_2$, in order to manually rotate the adjusting shaft 39 in a state in which the supply of electric power to the second geared motor $M_2$ is cut off. It-is preferred that the adjusting knob 41*a* be formed separately from the adjusting shaft 39, in order to achieve an easy assembling process for assembling the adjusting knob 41*a* to the foothold 18.

A second switch $S_2$ is also provided to control the supply of electric power to the second geared motor $M_2$, thereby controlling the rotation of the grip bar 38. This second switch $S_2$ is installed on the casing 20 mounted on the upper end of the base frame 10.

For reference, the procedure for assembling the elements of the foot holder moving means B will be described hereinafter. First, the second pinion 37 attached with the grip bar 38 is received in the housing 36 in such a manner that it engages with the second internal gear 36*a* with the grip bar 38 extending through the arcuate slot 36*d* of the housing 36. Thereafter, the second and third spacers 43 and 44 are welded to the housing 36 in a state in which they are fitted in the holes 36*b* and 36*c* of the housing 36, respectively. The assembled housing 36 is then welded to the free end of the extension member 16 extending from the mat frame 15.

Meanwhile, the mounting plate 45 is fixedly mounted to the second geared motor $M_2$ by means of the key and snap ring 46. In this state, the eccentric shaft 40 and adjusting shaft 41 are assembled to the output shaft 39 of the second geared motor $M_2$ in such a manner that the pin holes of those shafts are aligned together. The pin 47 is then fitted in the aligned pin holes, thereby causing the shafts 39, 40 and 41 to be integral with one another. Thereafter, the second geared motor $M_2$ assembled as mentioned above is assembled to the housing 36 in such a manner that the eccentric shaft 40 is fitted in the central holes of the second and third spacers 43 and 44, and the central hole of the second pinion 37. In this state, the mounting plate 45 is fixedly mounted to the housing 36 by means of coupling pieces 48. The footholds 18 are then coupled to opposite sides of the housing 36, respectively. Finally, the adjusting knob 41*a* is coupled to the end of the adjusting shaft 41 protruded from the outer end of the foothold 18 opposite to the second geared motor $M_2$.

Now, the operation of the exercise device having the above mentioned configuration according to the present invention will be described.

When it is desired to use the exercise device, the user first manipulates the first switch $S_1$ to rotate the mat frame 15 to a state in which the free end of the extension member 16 is positioned at its lowermost position, as indicated by the solid line in FIG. 2. The user then leans against the mat 15*a* while treading on the footholds 18 with his feet under the condition in which his ankle portions are positioned between the associated support bars 17 and foot holders 19, respectively. In this state, the second switch $S_2$ installed on the casing 20 is manipulated to operate the foot holder moving means B, thereby rotating the foot holders 19 to a position at which the foot holders 19 tightly hold the ankle portions of the user.

The operation of the foot holder moving means B is carried out as follows.

When the user manipulates the second switch $S_2$, electric power from an external power supply source is supplied to the second geared motor $M_2$ which, in turn, drives in one direction.

The drive force from the second geared motor $M_2$ is then transmitted to the eccentric shaft 40 via the output shaft 39. As the eccentric shaft 40 rotates eccentrically by the drive force transmitted thereto, the second pinion 37 rotates eccentrically with respect to the second internal gear 36*a*. As a result, the second internal gear 36*a* rotates at a speed reduced from the rotating speed of the second geared motor $M_2$. The rotation of the second internal gear 36*a* results in a rotation of the grip bar 38 at a desired speed.

As the grip bar 38 rotates, the foot holders 19 rotate, thereby coming into contact with the ankle portions of the user laid on the support bars 17 while depressing the ankle portions against the support bars 17 at a desired pressure. Accordingly, the ankle portions of the user are held between the support bars 17 and foot holders 19. Since the support bars 17 and foot holders 19 have symmetrical arcuate shapes, respectively, they surround the ankle portions of the user while being in close contact with those ankle portions.

Accordingly, the support bars 17 and foot holders 19 hold the ankle portions of the user in an increased contact area. Therefore, it is possible to hold the ankle portions of the user more stably and comfortably. In addition, it is possible to protect the body of the user by virtue of the cushioning members 17*a* and 19*a* more securely.

In the above state in which the feet and ankle portions are held at the free end of the extension member 16, the user can perform a sit-up exercise or a hanging exercise after rotating the mat 15*a* by a desired angle using the mat rotating means A.

Now, the procedure for rotating the mat frame 15 will be described.

When the user manipulates the first switch $S_1$, electric power from the external power supply source is supplied to the first geared motor $M_1$ which, in turn, generates a drive force. The drive force from the first geared motor $M_1$ is then transmitted to the eccentric shaft 26 via the output shaft 25.

As the eccentric shaft 26 rotates eccentrically by the drive force transmitted thereto, the first pinion 22 rotates eccentrically with respect to the first internal gear 21. As a result, the first internal gear 21 rotates at a speed reduced from the rotating speed of the first geared motor $M_1$. The rotation of the first internal gear 21 results in a rotation of the rotating member 24 fixed to the first pinion 22 at a desired speed.

As the rotating member 24 rotates, the connecting member 23 rotates. The rotation of the connecting member 23 results in a rotation of the mat frame 15, and thus, the mat 15*a*, by a desired angle. The rotation angle, namely, inclination angle, of the mat 15*a* is determined by a manipulated degree of the first switch $S_1$. Thus, the mat 15*a* may be positioned at a desired using position, for example, a position indicated by the double-dotted line in FIG. 2.

When it is desired to return the mat 15*a* from the using position to the original position, the first switch $S_1$ is manipulated again. By this manipulation, the first geared motor $M_1$ drives reversely. Accordingly, the entire mechanism of the mat rotating means A operates reversely. Thus, the mat 15*a* can return to its original position in accordance with an appropriate manipulated degree of the first switch $S_1$. Meanwhile, when the second switch $S_2$ is manipulated again, the second geared motor $M_2$ drives reversely, thereby causing the grip bar 38 to return to its original position. As a result, the foot holders 19 are released from the ankle portions of the user.

Where it is desired to release the foot holders 19 from the ankle portions of the user in a state in which the supply of electric power to the second geared motor $M_2$ is cut off, the user manually rotates the adjusting knob 41*a* in a desired direction. The rotation of the adjusting knob 41*a* results in a rotation of the second pinion 37 via the adjusting shaft 41 and the eccentric shaft 40 connected to the adjusting shaft 41. Accordingly, the grip bar 38 fixed to the second pinion 37 returns to its original position. Thus, the foot holders 19 are manually released.

As is apparent from the above description, the exercise device of the present invention has a simple configuration capable of reducing the manufacturing costs. The exercise device also has a greatly reduced volume and weight, thereby achieving easy installation and transportation. Since the exercise device also includes the foot holder moving means capable of tightly holding the ankle portions of the user, an improvement in stability is ensured during the use of the exercise device. This results in improved reliability.

INDUSTRIAL APPLICABILITY

The exercise device of the present invention can be more effectively used not only for an exercise such as a sit-ups exercise or a reverse hanging exercise, but also for leisure, because it is configured to optionally rotate its mat by a desired angle while firmly holding the ankle portions of the user.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An exercise device for use by a user having ankle portions, the device comprising:

a base frame having a stable self-supporting strut structure;

a mat frame rotatably mounted on an upper end of the base frame for supporting a mat on which a user can lean or lay;

a length-adjustable extension member fixed at one end thereof to one longitudinal end of the mat frame;

ankle holding means installed on a free end of the extension member and adapted to hold the ankle portions of the user utilizing the device, the ankle holding means including a pair of footholds fixedly mounted to the free end of the extension member while extending laterally from the free end of the extension member in opposite directions, respectively, a pair of support bars fixedly mounted to an end portion of the extension member disposed near the free end of the extension member while extending laterally from the free end of the extension member in opposite directions, respectively, and a pair of foot holders hingably mounted to the free end of the extension member in such a manner that the foot holders move with respect to the support bars, respectively;

mat rotating means provided with a first geared motor and adapted to rotate the mat frame through a desired angle by a drive force from the first geared motor in a speed-reduced manner; and foot holder moving means provided with a second geared motor and adapted to move the foot holders between an ankle holding position where the foot holders are positioned near the support bars, respectively, to hold the ankle portions of the user therebetween and a release position where the foot holders are spaced away from the support bars, respectively, to allow the ankle portions of the user to be released, the movement of the foot holders being provided by a drive force from the second geared motor in a speed-reduced manner.

2. An exercise device according to claim 1, wherein the mat rotating means comprises:

a casing fixedly mounted on the upper end of the base frame;

an internal gear fixedly fitted in the casing and attached with a spacer to which the first geared motor is fixedly mounted;

a pinion received in the internal gear, the pinion having a dedendum circle smaller than that of the internal gear in such a manner that the pinion engages partially with the internal gear;

a circular rotating member disposed at one side of the casing and fixedly mounted to the pinion in a concentric manner, the circular rotating member being provided at a circumferential outer surface thereof with a connecting member connected to the mat frame, such that the rotating member rotates the mat frame by a rotating force from the pinion;

an eccentric shaft extending through an axial hole centrally defined in the pinion, the eccentric shaft having a central axial hole and an eccentric shaft portion fixedly fitted in the axial hole of the pinion, thereby causing the pinion to engage partially with the internal gear; and a fixing member fixedly mounted to the internal gear and adapted to rotatably support an end of the eccentric shaft protruded from the axial hole of the pinion opposite to the first geared motor wherein the first geared motor is provided with an output shaft fixedly fitted in the central axial hole of the eccentric shaft in such a manner that the output shaft and the eccentric shaft rotate together, the first geared motor being adapted to rotate the output shaft in forward and reverse directions in accordance with electric power externally applied thereto.

3. An exercise device according to claim 1, wherein each of the support bars and the foot holders have arcuate shapes mating with each other in such a fashion that the support bars and foot holders hold the ankle portion of the user while surrounding the ankle portion in a wider contact area, respectively, and cushioning members are fitted around the support bars and the foot holders, respectively.

4. An exercise device according to claim 1, wherein the foot holder moving means comprises:

a ring-shaped housing fixedly mounted to the free end of the extension member between the footholds;

an internal gear formed in the housing;

a circumferentially-extending arcuate slot formed through a portion of the housing disposed at one side of the internal gear;

a pinion received in the internal gear, the pinion having a dedendum circle smaller than that of the internal gear in such a manner that the pinion engages partially with the internal gear;

a grip bar attached at one end thereof with the foot holders and fixed at the other end thereof to one side of the pinion in such a manner that the grip box extends through the arcuate slot, the grip bar moving along the arcuate slot between two positions respectively corresponding to the ankle holding and release positions of the foot holders when the pinion rotates;

a pair of spacers fixedly fitted in the housing in opposite sides of the internal gear, respectively, and adapted to prevent the pinion from being separated from the internal gear;

an eccentric shaft extending axially through the pinion and the spacers, the eccentric shaft having a central axial hole and an eccentric shaft portion fixedly fitted in the axial hole of the pinion, thereby causing the pinion to engage partially with the internal gear;

the second geared motor fixedly mounted to the housing by a mounting plate fixed to the end of the housing where the arcuate slot is formed, the second geared motor being provided with an output shaft fixedly fitted in the central axial hole of the eccentric shaft in such a manner that the output shaft and the eccentric shaft rotate together and serving to rotate the output shaft in forward and reverse directions in accordance with electric power externally applied thereto.

5. An exercise device according to claim 4, wherein the foot holder moving means further comprises:

an adjusting shaft fixedly mounted at one end thereof to the output shaft of the second geared motor and provided at the other end thereof with an adjusting knob adapted to manually rotate the adjusting shaft, the adjusting shaft adapted to rotate the output shaft in accordance with a manual rotation of the adjusting knob, thereby rotating the grip bar, when a supply of electric power to the second geared motor is cut off.

6. An exercise device according to claim 4, wherein the foot holder moving means further comprises:

an arcuate cushioning member fitted in the arcuate slot and allowing the grip bar to move between the two positions thereof, the arcuate cushioning member being adapted to absorb an impact generated when the grip bar strikes against the housing at opposite ends of the arcuate slot.

* * * * *

UNITED STATES PATENT AND TRADEMARK OFFICE

CERTIFICATE OF CORRECTION

PATENT NO. : 6,149,560
DATED : November 21, 2000
INVENTOR(S) : Hyung Jun Kim

It is certified that error appears in the above-identified patent and that said Letters Patent is hereby corrected as shown below:

Column 4 Line 3, "Referring to FIG. 2" should read --Referring to FIG. 1 and FIG. 2"--.

Column 5 Line 59 "switch Si" should read --switch $S_1$--.

Column 7 Line 55 "It-is" should read --It is--.

Signed and Sealed this

First Day of May, 2001

*Attest:*

Nicholas P. Godici

NICHOLAS P. GODICI

*Attesting Officer*

*Acting Director of the United States Patent and Trademark Office*